US008151861B2

(12) United States Patent
Wang et al.

(10) Patent No.: US 8,151,861 B2
(45) Date of Patent: Apr. 10, 2012

(54) ONE-PIECE CORE MANUFACTURING METHOD FOR SWING BOLSTER AND SIDEFRAME OF LORRY

(75) Inventors: Yundong Wang, Sichuan (CN); Wuyi Xu, Sichuan (CN); Zhu Li, Sichuan (CN); Xiaoming Yang, Sichuan (CN); Youping Liu, Sichuan (CN); Zhicheng Wang, Sichuan (CN); Chengyong Liu, Sichuan (CN); Minggao Qing, Sichuan (CN); Yonghong Yuan, Sichuan (CN)

(73) Assignee: CSR Meishan Rolling Stock Co., Ltd., Meishan (CN)

( * ) Notice: Subject to any disclaimer, the term of this patent is extended or adjusted under 35 U.S.C. 154(b) by 162 days.

(21) Appl. No.: 12/596,148

(22) PCT Filed: Mar. 6, 2008

(86) PCT No.: PCT/CN2008/070430

§ 371 (c)(1),
(2), (4) Date: Oct. 16, 2009

(87) PCT Pub. No.: WO2008/128451

PCT Pub. Date: Oct. 30, 2008

(65) Prior Publication Data

US 2010/0126687 A1 May 27, 2010

(51) Int. Cl.
*B22C 9/10* (2006.01)

(52) U.S. Cl. ..... 164/28; 164/185; 164/186; 164/228; 164/369; 164/379

(58) Field of Classification Search ..... 164/183–186, 164/228, 230, 205, 224, 379–380, 411, 28, 164/369

See application file for complete search history.

(56) References Cited

U.S. PATENT DOCUMENTS

| | | | | |
|---|---|---|---|---|
| 1,350,564 | A * | 8/1920 | Pattison | 164/148.1 |
| 1,855,409 | A * | 4/1932 | Nicholls | 164/185 |
| 5,954,114 | A | 9/1999 | Bauer et al. | |
| 2003/0221811 | A1 | 12/2003 | Smith et al. | |
| 2005/0199365 | A1 * | 9/2005 | Pfeifer et al. | 164/132 |

FOREIGN PATENT DOCUMENTS

| | | | |
|---|---|---|---|
| CN | 1923406 | A | 3/2007 |
| CN | 101066554 | A | 11/2007 |
| JP | 9019743 | A | 1/1997 |

OTHER PUBLICATIONS

Bai, Wendi, "Process of Automatic No Bake Sand Molding & Core Making Production Line for Manufacturing Steel Castings," Foundry Technology, Apr. 2001, No. 2, pp. 20-22.

* cited by examiner

*Primary Examiner* — Kuang Lin
(74) *Attorney, Agent, or Firm* — Mei & Mark LLP

(57) ABSTRACT

A one-piece core-making technique used in producing railway truck bolsters and side frames, which includes the following steps: 1. After scraping the top of a core box, applying a shaped top mould (11), which is precisely located, from top to bottom. 2. Press or slightly hit the top mould (11) to make sure the top mould covers/caps the scraping surface. 3. Keep pressing to make sure that the flat scraping surface was pressed to a required curved shape, like the shape of the top mould (11). 4. Last, it will become a one-piece core with a partially integrated inner cavity section. The one-piece core made by this technique has a smooth surface. This technique also can improve the internal quality of the product and ease work intensity.

2 Claims, 4 Drawing Sheets

ONE-PIECE CORE MANUFACTURING METHOD FOR SWING BOLSTER AND SIDEFRAME OF LORRY

FIELD OF THE INVENTION

The present invention relates to a one-piece core-making method different from other core shooting in casting and core producing methods, and especially relates to a one-piece core-making technique for railway truck bolsters and side frames.

BACKGROUND OF THE INVENTION

Bolsters and side frames are key parts for the running gear of railway trucks. The layered and sectioned manufacturing are generally by the core-making technique for forming the sand core of the core cavity in the process of manufacturing the bolster and side frame casts in China, and even throughout the world, as shown in FIGS. 1 and 2.

For adopting the layered and sectioned core-making techniques, the produced bolster and side frame mainly have disadvantages in two aspects:

The first disadvantage: the sand core connection part has an uneasily controlled gap due to sand core deformation or edge breakage, as shown in FIG. 5. The gap 3 makes the core cavity form a flash, especially a flash in the cavities corresponding to the key parts A and B of the bolster and side frame during the casting and shaping processes. And the connection part of the flash and the core cavity easily produces subsurface pores 8 and micro-cracks 7 during the solidification process of casts with flashes in the core cavity, as shown in FIG. 6. The subsurface pores 8 and micro-cracks 7 are not easily detected by common product testing because they are located in the core cavity, for example, which brings potentially dangerous qualities to products. As the key parts of the running gear of railway trucks, the bolster and the side frame have the pores and micro-cracks inside the cast which act as stress sources under the continuous cyclic stress during the operation of the railway truck. The stress gradually escalates, thus largely shortening the service life of the product. More seriously, micro-cracks gradually escalate and result in breakage of bolsters and side frames which causes a railway accident.

The second disadvantage: a core chaplet 9 is always used in order to strengthen the sand core location and ensure the cast wall thickness conforms to the requirements after core setting and before mould assembling when layering and sectioning the sand core, and the amount of the bolster or side frame used is more than 30, as shown in FIG. 7. The use of a core chaplet influences performance of the cast in the following three aspects: firstly, the core chaplet is not easy to fuse with the cast, thus reducing the useful sectional area of the cast, and producing partial stress to the corresponding part. The disadvantage of such stress, more specifically, is that the starting point of the micro-cracks gradually escalates under the cyclic stress and the stress can only be discovered by fatigue testing more than millions and even tens of millions of times. Secondly, the surface of the core chaplet easily erodes, and pores are generated during casting, and the plated tin or zinc reacts with molten steel though contacting, thereby making a byproduct in the partial cast which can be segregated to form a stress source so as to affect performance. Thirdly, when in use, the dropped upper mould sand 10 which is squeezed by the core chaplet directly falls into the mould cavity, as shown in FIG. 7, forming sand holes inside or on the surface of the cast. And the sand holes formed on the cavity surface are not easy to get rid of, leaving potential dangers in operation.

The main disadvantages above mentioned usually arise in railway operation, causing interruption of railways, and bringing great social and economic losses to railway transportation.

One-piece core making is required in order to eliminate such disadvantages. A common one-piece core-making solution uses a core shooter to shoot a core. The core shooting technique is usually a half-and-half type with a horizontal (transverse) mould closing. But the core shooter equipment is complicated, expensive and has high requirements for power, controlling parts and installation. Moreover, the sand core is partially over compacted and non-uniformly compacted, resulting in the generation of cracks in the cast.

SUMMARY

The object of the present invention is to provide a one-piece core-making technique for a railway truck bolster and a side frame, which integrates diverse sand cores into a uniform one, i.e. the one-piece core, based on traditional layered and sectioned core-making techniques.

The technical solution of the invention adopts a one-piece core-making technique for a railway truck bolster and a side frame, comprising the following steps:

A. the sand filling step: filling sand into the one-piece core box cavity with movable pieces placed into position and meanwhile putting in reinforced core bars, with the height of the sand filled appropriately higher than the scraping-off surface, and scraping off sand residue after tamping or jolt-ramming, so that the heights of the moulding sand and the core box top surface are the same;

characterized in that it further comprises the following steps:

B. the step of press forming the matched moulds: when the firmness of the core sand is still sufficient after sand filling, pressing the upper press mould down on the moulding sand inside the core box under the guidance action, slight hitting or pressing the upper press mould to attach it on the scraping-off surface, and proceeding to press down to make the base surface of the upper press mould adhere closely to the core box top surface, wherein the inner cavity shape of the upper press mould is the curved part to be pressed out, i.e. the shape of the sand core top;

C. the overturning and stripping step: after the base surface of the upper press mould adheres to the core box top surface, reinforcing the core sand firmness, and overturning the upper press mould and the core box in a tightly locked condition, then stripping with the core box lifted and the sand core enclosed by the movable pieces which are just disposed on the base surface of the upper press mould;

D. the step of withdrawing the movable pieces: taking out the movable pieces by sliding them along the base surface of the upper press mould;

E. the sand core hardening and coring step: the sand core to be made is supported by the upper press mould after withdrawal of the movable pieces. And, once the sand core is hardened to a required firmness, carrying on painting and cleaning.

Preferably, the core sand compression strength in step B before the upper press mould is pressed down is less than 0.04 MPa, and after the base surface of the upper press mould adheres to the core box top surface, the mould can be stripped when the compression strength of core sand is more than 0.06 MPa.

Beneficial effects of the invention are as follows:

1. Diverse sand cores are integrated into a uniform one; the one-piece core-making technique is adopted; the sand core surface is continuous and smooth; and the curved surface is completely connected. The core cavity produced by the one-piece core is smooth, seamless and flat, which effectively avoids the casting fin and joint flash brought about by using diverse composite sand cores.

2. The sand core has good quality, with a smooth surface and high precision of dimensions. The use of a large amount of movable pieces can form relatively complicated sand core shapes and have guaranteed quality. Compared with the layered core, the sectional area of the one-piece core is increased, and correspondingly, the rigidity and the deformation resistance are enhanced.

3. It facilitates the operations required by the technique. In other words, chilling blocks, core rod, exhaust pipe, moulding material such as chrome iron and ore are precisely located according to technical requirements.

4. Uniform compactness: the total volume of the sand core is compressed when the upper press mould presses downwards and moulds on the scraping-surface. At the upper part adjacent to the scraping-off surface, the total compactness of the one-piece core is uniform, which facilitates the moulding of the cast.

5. Simple equipment: a closing device (which can also have an added slight hitting function) is adopted to complete the mould closing for the upper press mould and the core box from the top down, which easily realizes the mechanical core making.

6. Convenient installation and maintenance: partial modifications or technical adjustments for the products can be easily finished by adjusting the movable pieces, which is flexible and strongly adaptable.

7. The quantity of the core chaplets used is maximally reduced, ensuring the cast is effectively using sectional area, which prevents the upper mould sand squeezed by the core chaplet and dropped off during mould assembling from directly falling into the mould cavity to form sand holes inside or on the surface of the cast during use of the core chaplet. And meanwhile it reduces the works to clean the core chaplet itself.

8. The quality of the core cavity surface is improved, and the difficulty in cleaning sand is reduced also.

9. The dimensional precision of the bolster and side frame cavities is improved. As the size of the corresponding position where the product cavity is formed is stable after the sand core is integrated, the wall thickness of the cast is uniform, effectively avoiding the stages generated by using diverse composite sand cores, and further ensuring the performances such as the intensity in use.

DESCRIPTION OF THE ACCOMPANYING DRAWINGS

Figure 1:
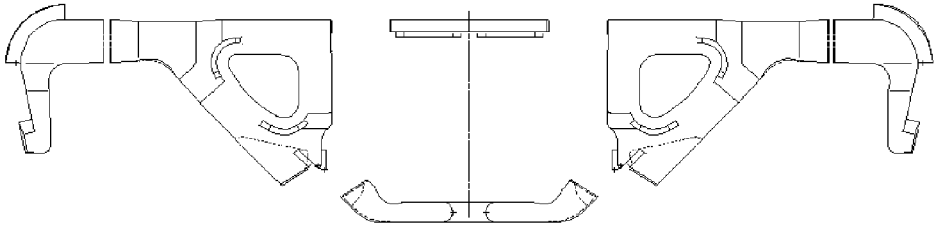
FIGS. 1 and 2 are schematic illustrations of the railway truck side frame core made by traditional layered and sectioned core-making techniques.
Figure 2:
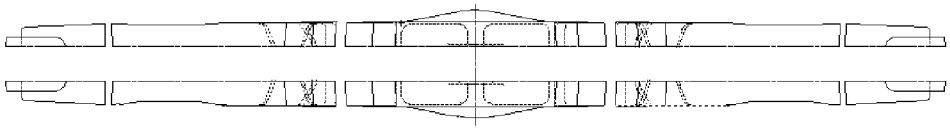

Reference signs: side frame cast 1, "X" sand core 2, sand core gap 3, parting (core) surface 4, "S" sand core 5, casting fin or joint flash 6, microcrack 7, pore 8, core chaplet 9, mould sand squeezed off by a core chaplet 10, upper press mould 11, basic surface 12, core box frame (body) 13, movable piece 14, movable piece 15, core rod 16, and sand core 17.

DESCRIPTION OF THE PREFERRED EMBODIMENTS

The present invention will be further described with reference to the accompanying drawings and embodiments.

Figure 8:
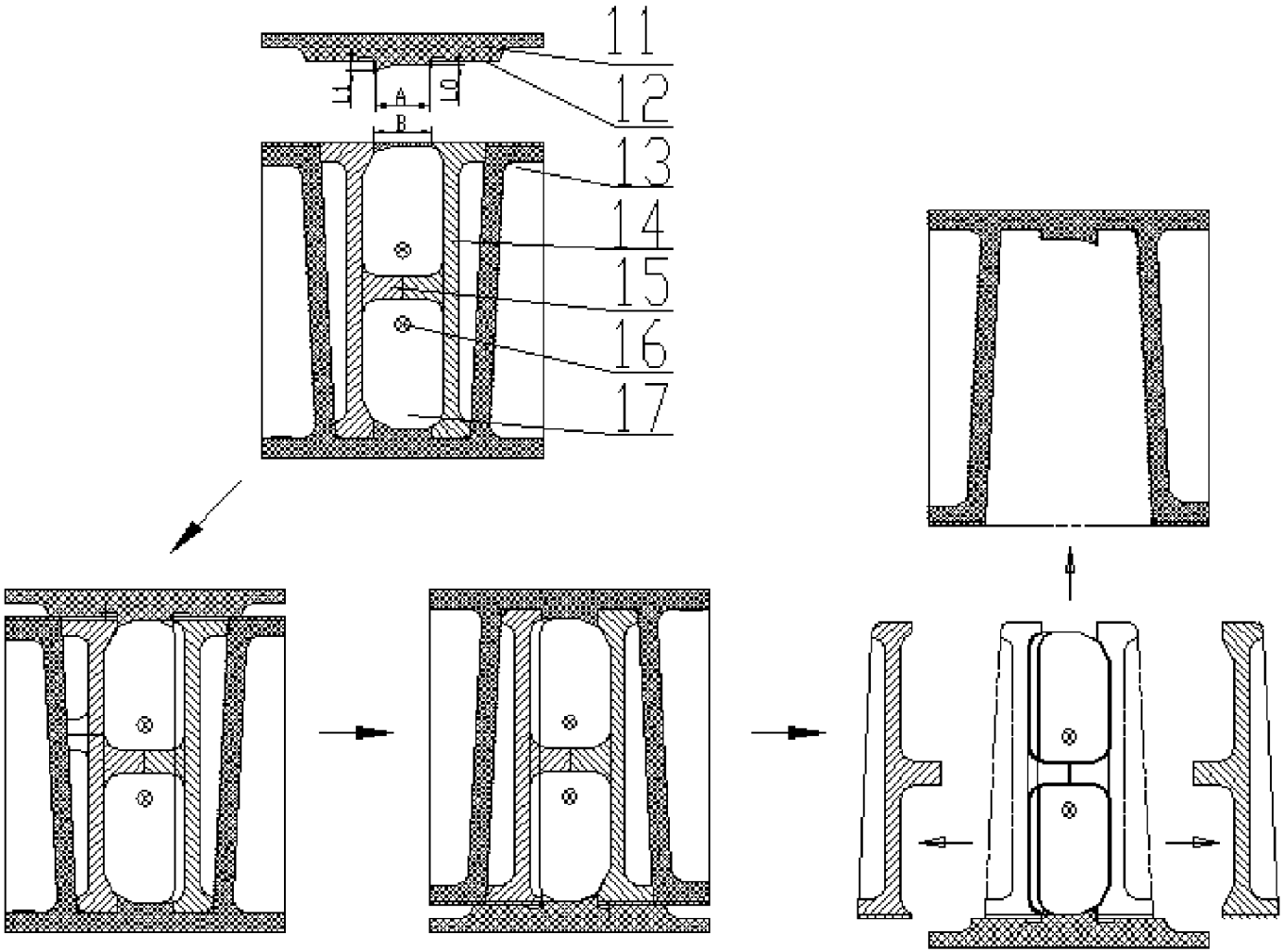
FIG. 8 is a schematic flow of the manufacturing technique according to the present invention.

According to an embodiment of the present invention, a one-piece core-making technique for a railway truck bolster and side frame is shown in FIG. 8 as flow diagram. The technique comprises the following steps:

A. the sand filling step: filling sand into the one-piece core box 13 cavity with movable pieces 14, 15 placed into position and meanwhile putting in reinforced core bars 16, with the height of the sand filled appropriately higher than the scraping-off surface, and scraping off sand residue after tamping or jolt-ramming, so that the heights of the moulding sand and the core box top surface are the same;

B. the step of press forming the matched moulds: when the firmness of the core sand is still sufficient after sand filling, pressing the upper press mould 11 down on the moulding sand inside the core box 13 under the guidance action, slight hitting or pressing the upper press mould 11 to attach it on the scraping-off surface, and proceeding to press down to make the base surface 12 of the upper press mould adhere closely to the core box 13 top surface, wherein the inner cavity shape of the upper press mould 11 is the curved part to be pressed out, i.e. the shape of the sand core top. The range of the upper press mould A is the curved part to be pressed out, L0 is the stroke that the top point of the sand core presses down, L1 is the stroke for forming a part of side circular bead.

Figure 3:
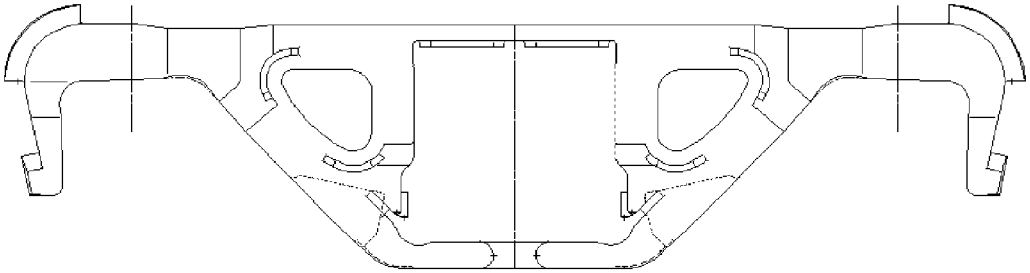
FIGS. 3 and 4 are schematic illustrations of the one-piece core made by the technique according to the present invention.
Figure 4:
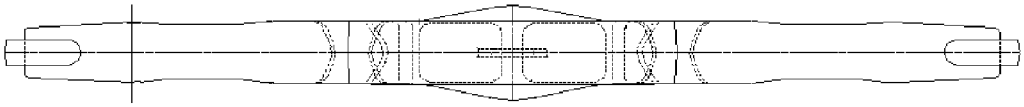
Figure 5:
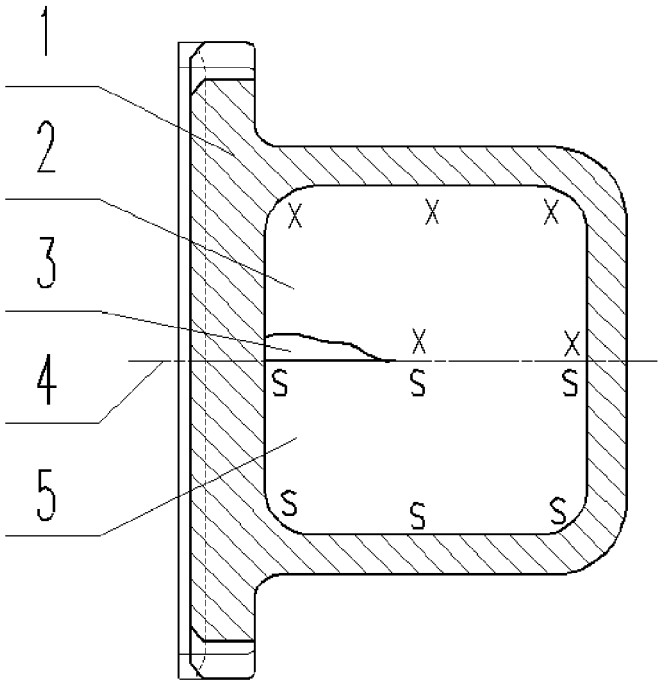
FIG. 5 is a schematic illustration of the gap present in the connection part of sand cores in traditional layered and sectioned core making techniques.
Figure 6:
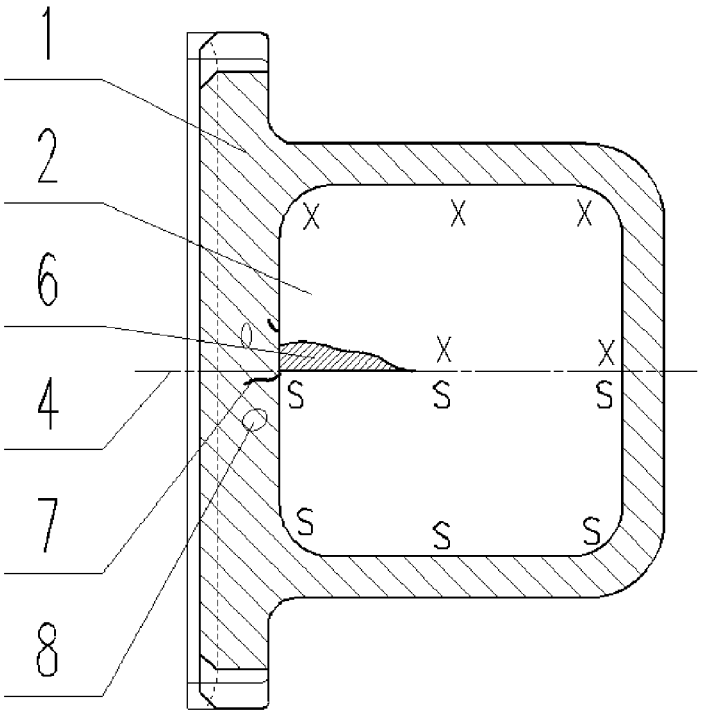
FIG. 6 is a schematic illustration of subsurface pores and micro-cracks caused by a casting fin of the cast.
Figure 7:
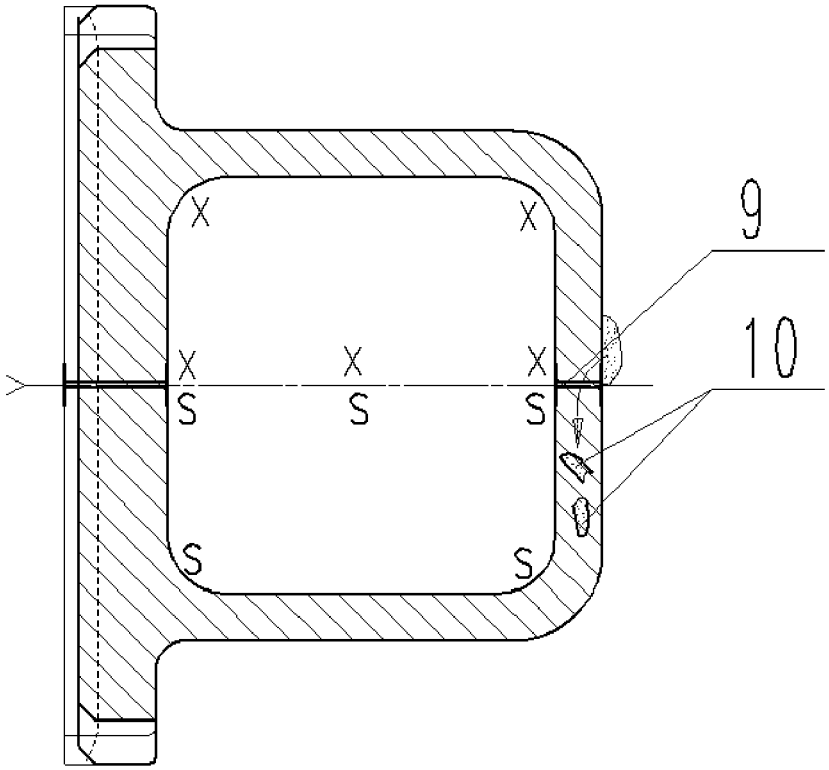
FIG. 7 is a schematic illustration of sand core falling off by using a core chaplet.

C. the overturning and stripping step: after the base surface of the upper press mould adheres to the core box top surface, reinforcing the core sand firmness, and overturning the upper press mould and the core box 180 degrees in a tightly locked condition, then stripping with the core box lifted and the sand core enclosed by the movable pieces which are just disposed on the base surface 12 of the upper press mould;

D. the step of withdrawing the movable pieces 14, 15: taking out the movable pieces 14, 15 by sliding them along the base surface 12 of the upper press mould;

E. the sand core hardening and coring step: the sand core to be made is supported by the upper press mould 11 after withdrawal of the movable pieces. When the sand core is hardened to the required intensity, carrying on painting and cleaning. And, finally, the core is taken out by the hanger or support equipment to a corresponding storage rack ready for use, and the finally formed one-piece sand core is shown in FIGS. 3 and 4.

In step B of this embodiment, for the purpose of facilitating the technique process, the hardness of the sand core is restricted, and the compression strength of core sand before the upper press mould is pressed down is less than 0.04 MPa. After the base surface of the upper press mould joints with the core box top surface, the compression strength of core sand is strengthened, and the mould is stripped when the compression strength of core sand is more than 0.06 MPa.

The invention claimed is:

1. A method for making a one-piece core for a railway truck bolster or a railway truck side frame, wherein the one-piece core is the only core used to form the entire railway truck bolster or railway truck side frame, the method comprising the steps of:

placing reinforced core bars and movable pieces into a one-piece core box cavity;

overfilling the core box cavity with sand;

tamping or jolt-ramming the sand;

scraping off sand residue so that a height of the sand is at a same height as a top surface of the core box;

when the core sand firmness is sufficient, and using an upper press mould having a curved inner cavity shape, pressing the empty upper press mould down on the sand in the core box by using a guidance action, a slight hit, or by pressing the upper press mould to connect the upper press mould to the scraped-off surface;

continuing to press down the upper press mould to make a base surface of the upper press mould adhere closely to the top surface of the core box;

after adhering the base surface, making the core sand firmer;

overturning the upper press mould and the core box;

lifting the core box while a formed sand core is enclosed by the movable pieces and the movable pieces are disposed on the base surface of the upper press mould;

sliding the movable pieces along the base surface to remove the movable pieces from the sand core;

after removing the movable pieces, supporting the sand core on the base surface while hardening the sand core; and cleaning the sand core after it is hardened to a required firmness.

2. The method of claim 1, wherein:

the sand in the core box has a compression strength of 0.04 MPa before the upper press mould is pressed down, and the sand in the core box has a compression strength of more than 0.06 MPa after the base surface adheres to the core box top surface.

* * * * *